US005489195A

United States Patent [19]

Domagalla et al.

[11] Patent Number: 5,489,195

[45] Date of Patent: Feb. 6, 1996

[54] LIQUID RING PUMP HAVING A SHEET METAL VALVE PLATE

[75] Inventors: Klaus Domagalla, Nutteln; Siegfried Auschrat, Heiligenstedten, both of Germany

[73] Assignee: SIHI GmbH & Co KG, Itzehoe, Germany

[21] Appl. No.: 310,168

[22] Filed: Sep. 21, 1994

[30] Foreign Application Priority Data

Sep. 23, 1993 [DE] Germany ..... 43 32 275.1

[51] Int. Cl.[6] ..... F04C 19/00; F04B 53/16

[52] U.S. Cl. ..... 417/68; 417/DIG. 1; 29/890.132

[58] Field of Search ..... 417/68, 69, DIG. 1; 29/890.12, 890.122, 890.132; 137/625.3; 251/208

[56] References Cited

U.S. PATENT DOCUMENTS

| | | | |
|---|---|---|---|
| 4,443,158 | 4/1984 | Bentele et al. | 417/68 |
| 4,817,265 | 4/1989 | Trimborn | 29/527.6 |
| 4,854,024 | 8/1989 | Grieb et al. | 29/890.132 |

FOREIGN PATENT DOCUMENTS

| | | | |
|---|---|---|---|
| 2317420 | 3/1975 | Germany | 417/68 |
| 2731451 | 4/1978 | Germany | 417/68 |
| 4118843 | 2/1993 | Germany | 417/68 |
| 2050513 | 1/1981 | United Kingdom . | |

*Primary Examiner*—Richard A. Bertsch
*Assistant Examiner*—Roland G. McAndrews, Jr.
*Attorney, Agent, or Firm*—Chilton, Alix & Van Kirk

[57] ABSTRACT

Liquid-ring gas pump with a working chamber in which an impeller (6) rotates and which is bounded axially by a control plate (7) past which the impeller (6) moves with a small clearance and which has at least one intake and/or discharge opening (21, 22, 23) and is composed of rolled sheet. According to the invention, the edges (26) of the intake and discharge openings are at least in part bent over towards the side facing away from the impeller (6) and are rounded on the side facing the impeller and raised on the side facing away from it.

14 Claims, 6 Drawing Sheets

LIQUID RING PUMP HAVING A SHEET METAL VALVE PLATE

Figure 1:
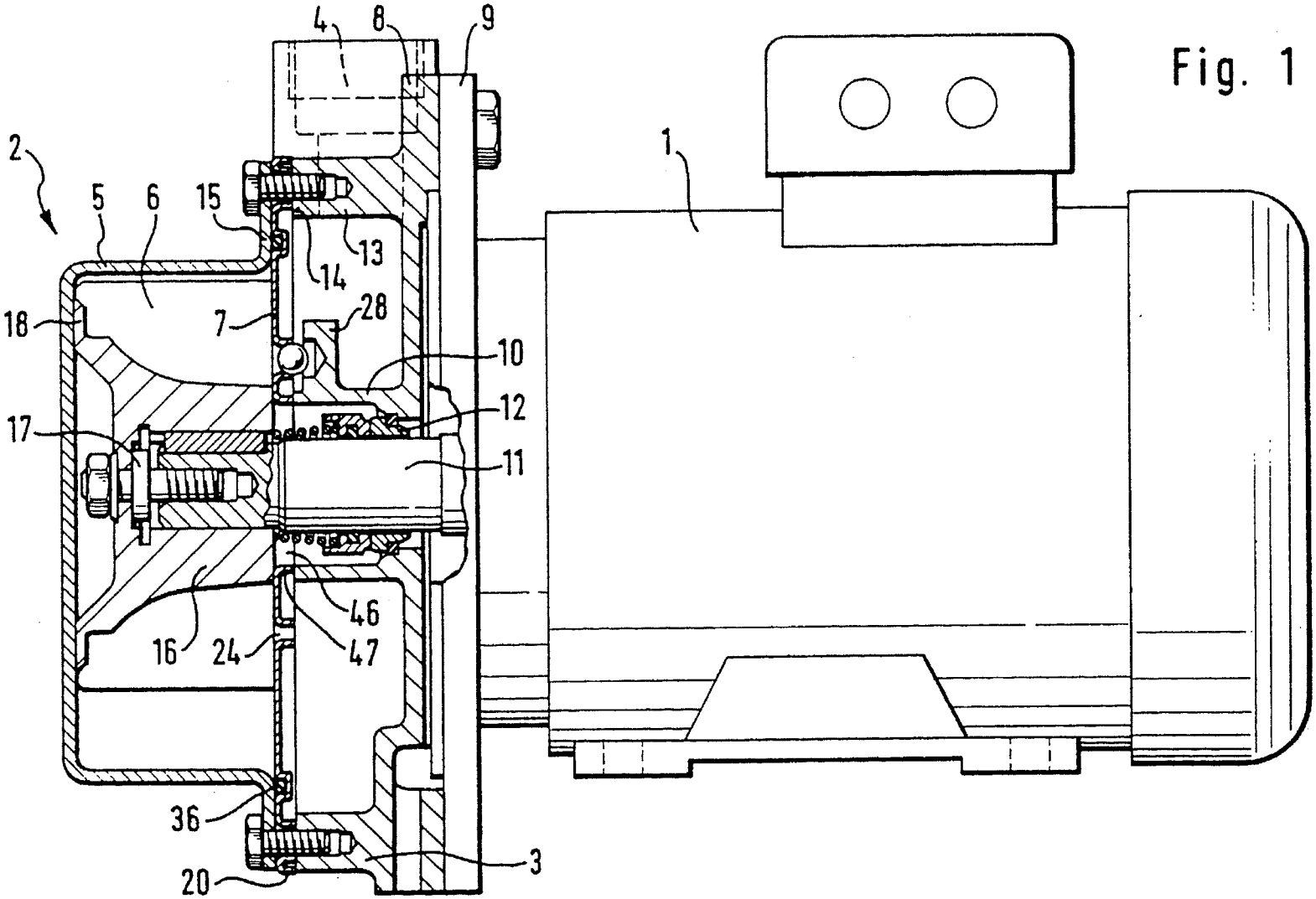

The invention relates to a liquid-ring gas pump with a working chamber in which an impeller rotates and which is bounded axially by a control plate past which the impeller moves with a small clearance and which has at least one intake and/or discharge opening to allow gas and liquid into and out of the working chamber.

In a liquid-ring gas pump, the gas to be delivered is compressed in the cells of the impeller by virtue of the fact that the liquid ring situated eccentrically with respect to the impeller in the working chamber penetrates from the outside into the impeller as the gas moves from the inlet to the outlet opening and thereby reduces the free cell volume. The efficiency of the pump depends on preventing the gas compressed in one cell from escaping through the gap between the impeller and the control plate into the next cell, in which the pressure is lower. It is therefore necessary, on the one hand, that the impeller should move past the control plate with as small a clearance as possible, generally of the order of a tenth of a millimeter. On the other hand, the impeller must not touch the control plate because this can lead to undesirably severe wear and even to cold welding between the impeller and the control plate and hence to total failure of the pump. To allow the control plates to be produced with sufficient accuracy, they have hitherto predominantly been produced from cast or forged material with a large wall thickness, and this is expensive. However, the use of a relatively thin-walled special-steel plate is also already known, this plate being welded on the side facing away from the working chamber to a cast supporting body or one cut out of thick material (DE-C 36 17 344). However, this is likewise very expensive and is therefore only justified when the supporting body can be manufactured from a less expensive material than the special-steel cover plate.

The object on which the invention is based is to provide a control plate which is less expensive than the known control plates and is nevertheless dimensionally stable.

The solution according to the invention consists in that the rolled-sheet control plate, which is not connected to a special supporting body, is at least in part bent over towards the side facing away from the impeller at the edges of the intake and discharge opening, is rounded on the side facing the impeller and raised on the side facing away from the latter. This configuration makes it possible to form the control plate from inexpensive rolled material in a simple forming process. The bent-over edges of the control openings, which project in a raised manner towards the side facing away from the impeller, have a reinforcing effect and the control plate is thus dimensionally stable in relation to the prevailing pressure differences, despite its lack of thickness. The openings are preferably punched out, it being possible to combine the punching operation and the flanging operation which leads to the bending over of the edges of the openings into a single operation. The bending over of the edges of the openings also has the advantage that the material is not distorted during this deformation. The face of the control plate that faces the impeller remains flat and generally does not require any additional reworking.

It is not necessary that all the control openings and the whole of the edges of the control openings are of the design according to the invention. However, it is advantageous if at least the edges of the intake opening are flanged and the impeller-side corners rounded as a result. It may, on the other hand, be expedient to make the edge of the discharge opening unflanged and, if required, sharp at least in its rearward area (the area which the vanes of the impeller reach last).

The thickness of the rolled-sheet material used is expediently no greater than 4 mm and is more expediently between 2 and 3.5 mm.

The rounding of the edges of the openings on their side facing the impeller makes it possible to provide favourable inflow and outflow conditions. In certain areas, particularly at the radially outer edge of the continuously open discharge opening, this rounding can be designed with a larger radius than in the remaining edge regions of this opening or of the intake opening.

For hydraulic reasons, it may be expedient to screen off the area of the continuously open discharge opening which the vanes of the impeller reach first from the discharge chamber by a wall which is raised from the impeller-side surface plane of the control plate. This advantageously results—as seen from the impeller—in a pocket-shaped or trough-shaped depression which is open towards that area of the discharge opening which is further towards the rear in the direction of rotation. This pocket or trough can be produced easily by forming of the material like the flanges on the edges of the openings.

If, in addition to the continuously open discharge opening, the control plate also has further discharge openings, which can be closed by means of valves, the valve seats for the valves can be formed by the bent-over edge of the openings. In another embodiment of the invention, these valve openings are not flanged or at least not raised on the side of the control plate facing away from the impeller; instead, the control plate is rigidly and permanently connected in the corresponding area on the side facing away from the impeller to a special valve housing which forms the valve seats and gives the control plate additional rigidity and dimensional stability in this area. The component forming the valve housing can also be used to form the abovementioned cover for the area of the continuously open outlet opening which the impeller vanes reach first. For this purpose, this component is provided with an extension, a projection or a tongue which extends partially over the continuously open discharge opening.

To reinforce the control plate in the outer area, its outer edge may be flanged.

There is the possibility of improving the dimensional stability and rigidity in the radially inner area of the control plate as well, by deformation. Beads which preferably extend radially or have radially extending bend edges are expediently formed in the area of the hub of the impeller. The edge of any shaft penetration hole can also be made bent over and raised on one side. The bent-over edge can also be used to receive a bearing bush, which is, for example, pressed in. Such a bearing bush can be expedient if it is envisaged that the hub of the impeller should be supported on the control plate via a thrust bearing. This is also expedient because it is thereby possible to establish the desired magnitude of the play between the control plate and the vanes of the impeller.

Figure 2:
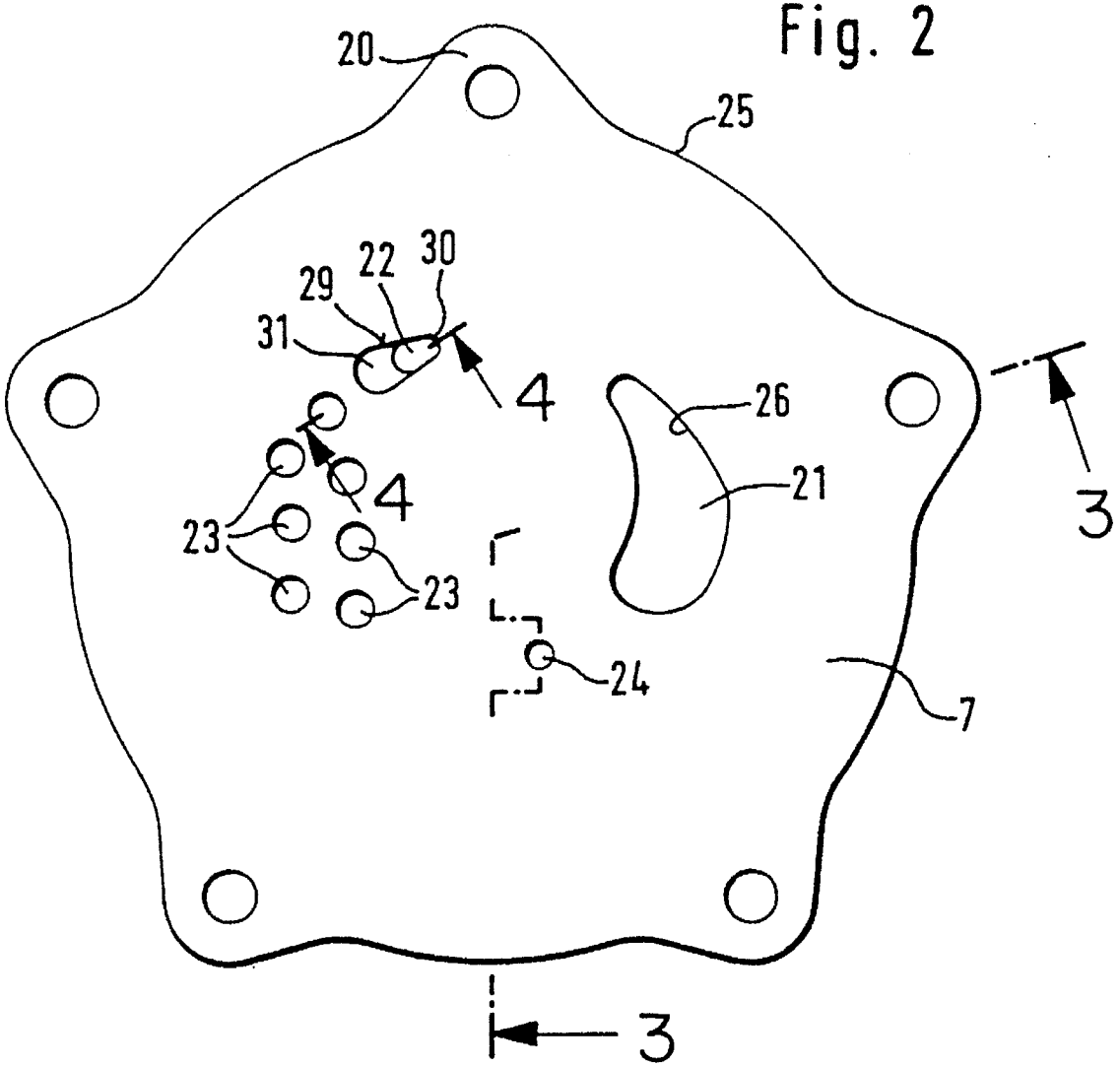
Figure 3:
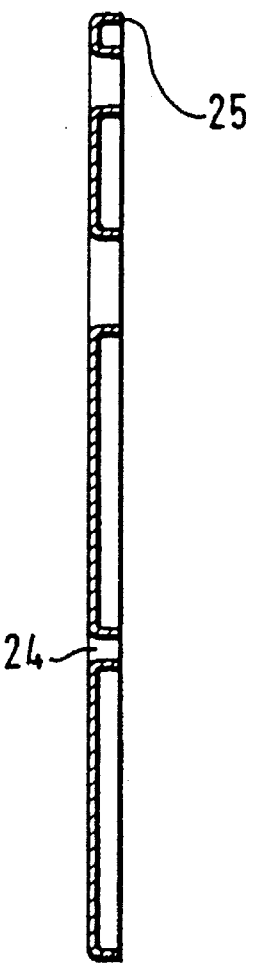
Figure 10:
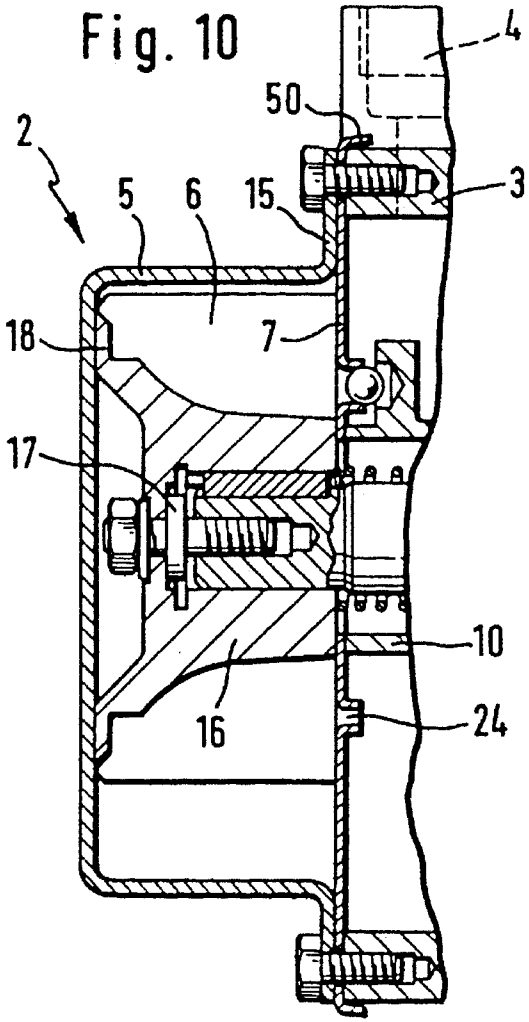
Figure 4:
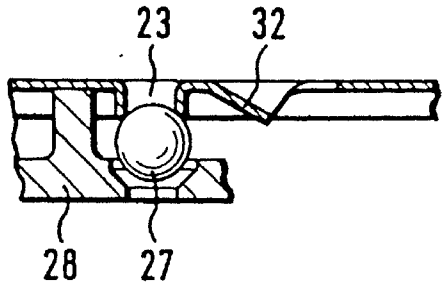
Figure 5:
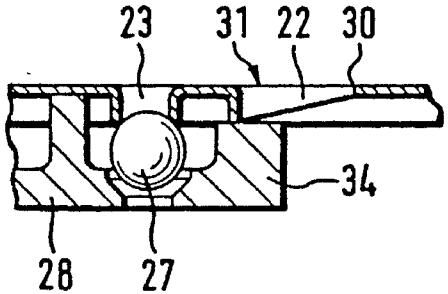
Figure 6:
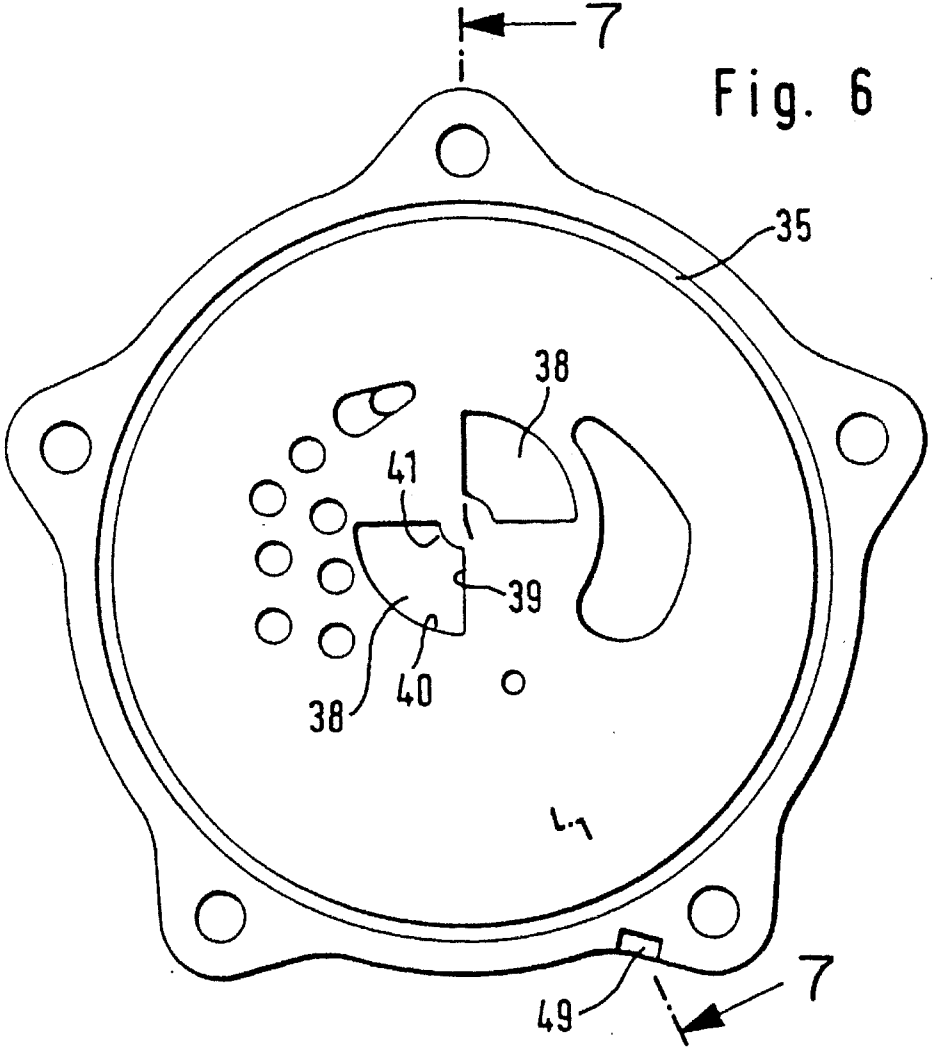
Figure 7:
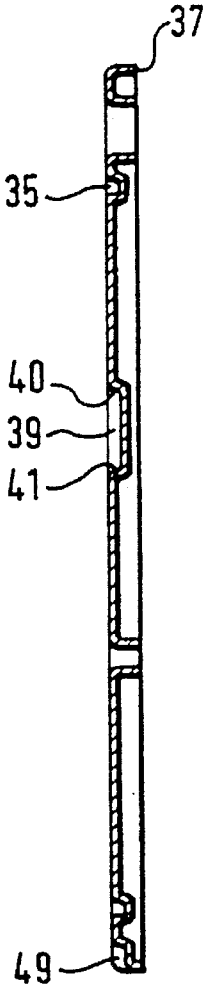
Figure 8:
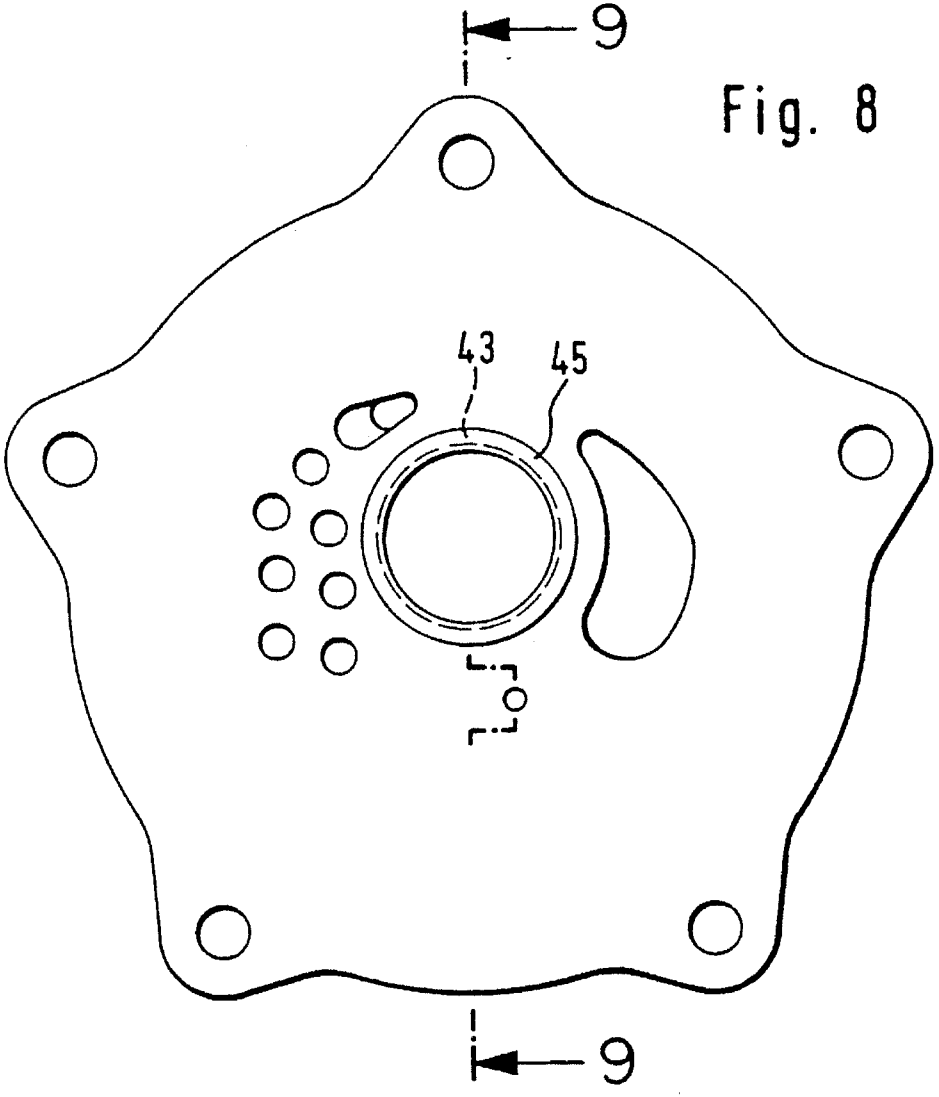
Figure 9:
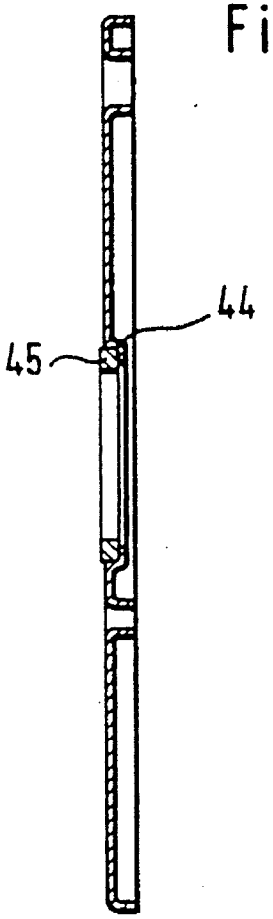

The invention is explained in greater detail below with reference to the drawing, which shows advantageous exemplary embodiments. In the drawing:

FIG. 1 shows a schematic longitudinal section through a pump according to the invention, FIG. 2 shows an axial view of a first embodiment of a control plate, FIG. 3 shows a section along line 3—3 in FIG. 2, FIG. 4 shows a partial section in accordance with line 4—4 in FIG. 2, FIG. 5 shows a partial section similar to that in FIG. 4 through another embodiment, FIG. 6 shows the axial view of a second embodiment of a control plate, FIG. 7 shows a section in accordance with line 7—7 in FIG. 6, FIG. 8 shows an axial view of a third embodiment of the control plate, FIG. 9 shows a section in accordance with line 9—9 in FIG. 8 and FIG. 10 shows a partial longitudinal section corresponding to FIG. 1 through another embodiment.

Figure 11:
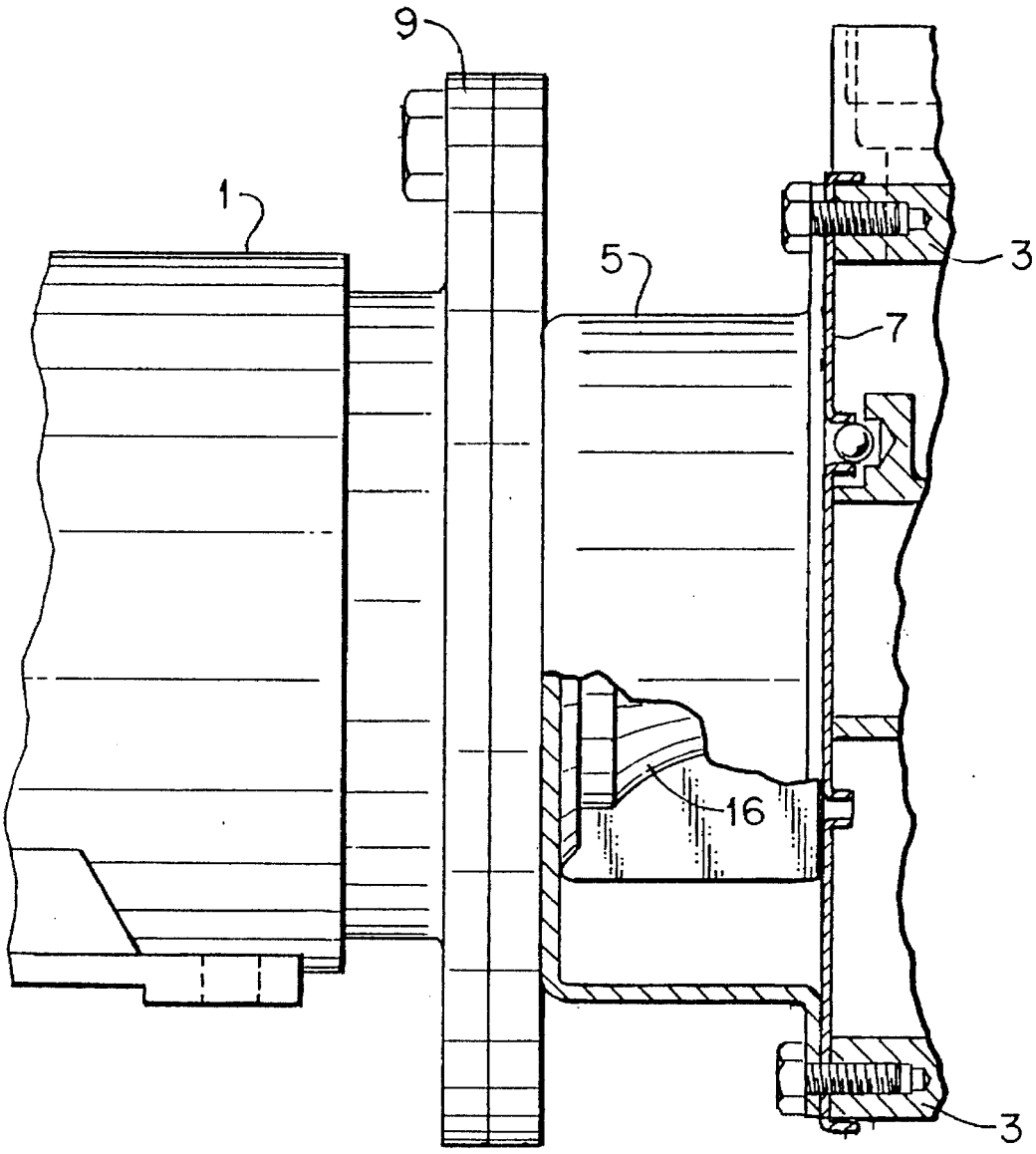

FIG. 11 shows a partial longitudinal section through still another embodiment.

The liquid-ring gas pump 2 driven and supported by a driving motor 1 comprises a housing part 3 which forms the intake and discharge connections, of which one can be seen at 4, and which is therefore referred to here as the connection housing. It furthermore comprises a working-chamber housing 5, in which the impeller 6 rotates, and a control plate 7 arranged between the connection housing 3 and the working-chamber housing 5.

The connection housing 3 has a flange 8, which is connected to the motor flange 9, and a housing hub 10, which surrounds a mechanical seal 12 that seals off the shaft stub 11 of the motor 1. The connection housing 3 furthermore forms an outer housing shell 13, from which the connection stubs 4 project and the flat end face 14 of which is bolted to the flange 15 of the working-chamber housing 5, with the control plate 7 enclosed between them.

The shaft stub 11 of the motor 1 carries the hub 16 of the impeller 6, the axial position of which on the shaft stub 11 can be adjusted by means of a known adjusting device 17. The vanes of the impeller 6 are connected to one another on the side facing away from the motor 1 by a disc 18 which substantially closes off on this side the cells formed between the vanes of the impeller. On the other side, the impeller cells are open towards the control plate 7 and, as a result, the gas and operating liquid to be delivered can flow into the impeller cells through the intake opening provided in the control plate 7 and flow out again through the discharge opening in a known manner.

The control plate has an essentially circular disc-shaped form, with, if required, a number of radial fastening projections 20 at the circumference. The intake opening 21, the continuously open discharge opening 22 and the discharge openings 23 that can be closed by valves are arranged at a customary location therein. An operating-liquid feed opening 24 can furthermore be provided at a suitable location, its edge expediently likewise being flanged.

According to the invention, it consists of a metal rolled sheet of a thickness such that it can be subjected to a forming process, in which it is cut out, its openings are punched out and the edges involved are bent over in a particular manner. To this end, the thickness should not be more than 4 mm. A thickness of about 3 mm up to a working-chamber diameter of about 300 mm has proven suitable.

The entire encircling edge 26 of the intake opening 21 is flanged, with the result that it is rounded towards the working chamber, while the flanged edge part projects in a raised manner towards the other side. This provides favourable guidance, in terms of flow, for the medium flowing into the working chamber. The discharge opening is made up of a plurality of individual openings, namely the openings 23 that can be closed by means of valve balls 27 and the continuously open discharge opening 22. The whole of the edge of the valve openings 23 is flanged in the form of a collar, as can best be seen in FIG. 4. This provides good seating for the valve balls 27, which are held by a housing part 28 which extends parallel to the control plate on the side of the latter facing away from the impeller. To form the valve seat, the flanged edges of the openings 23 can be machined. However, this is often not necessary.

At its end 30 acting at the rear in the direction of rotation, the continuously open discharge opening 22 expediently has an unflanged edge. This is intended to ensure that this edge has as small as possible an axial extent so as to offer as little resistance as possible to the medium striking against it. At its radially inner and radially outer edge portions, the continuously open discharge opening 22 is expediently flanged. In its portion situated at the front in the direction of rotation, which is therefore passed over first by the vanes of the impeller, it expediently has a cover on the side facing away from the impeller. As can best be seen in FIG. 4, this cover 32 can be produced by deep-drawing the material of the control plate into the form of a trough. As indicated in FIG. 5, the covering of the area 31 can, however, also be performed by a projection 34 on the housing part 28 containing the valve balls 27. This housing part can additionally be designed and connected to the control plate 7 in such a way that the said control plate is thereby reinforced in the region of the discharge openings 22, 23.

If the control plate shown in FIGS. 2 to 4 is arranged in the pump in the manner shown in FIG. 1, it has a shaft penetration opening 46 with a bent-over edge 47 in the centre. Such a shaft penetration opening is not required if the arrangement of the connection housing 3 and of the working-chamber housing 5 in relation to the driving motor 1 is reversed vis-a-vis the arrangement shown in FIG. 1.

The above explanation of FIGS. 2 to 5 also applies to the embodiment in accordance with FIGS. 6 and 7 and to the embodiment in accordance with FIGS. 8 and 9, unless stated otherwise below.

In the embodiment in accordance with FIGS. 6 and 7, a groove 35 is pressed in at the circumference and this groove serves to accommodate a sealing ring 36 (FIG. 1) in order to effect sealing relative to an adjoining housing part. The circumferential edge 37 of the control plate is furthermore flanged in order thereby to achieve an additional stabilization. Finally, the central area adjacent to the hub 16 of the impeller 6 also has two mutually opposite, quadrant-shaped deep-drawn areas 38, the radial edges 39 and circumferentially extending edges 40, 41 of which form beads formed transversely to the plane of the control plate, these beads reinforcing the control plate. It is self-evident that these beads could also be arranged other than in quadrant-shaped distribution.

In the embodiment in accordance with FIGS. 8 and 9, a circularly bounded depression 43 is provided in the central area of the control plate. Its edge 44 forms a circular bead which reinforces the control plate. In addition, this bead forms a seat for a bearing ring 45 which, in interaction with the hub 16 of the impeller 6, forms a thrust bearing to take the thrust of the impeller 6. This is primarily of interest where the impeller is arranged on the shaft stub 11 in such a way as to be axially displaceable. This arrangement has the advantage that the contact of the impeller with the bearing ring 45 clearly defines its setting relative to the control plate 7 and hence a minimum play between the impeller and the control plate.

At the outer edge, the assembly-assisting beads 49 can be provided and these allow the insertion of a tool between the control plate and the adjoining component in order to lift the control plate away from this component.

FIG. 10 shows a variant of the embodiment in accordance with FIG. 1, in which the edge of the control plate 7 is clamped tightly between the flange 15 of the working-chamber housing 5 and the connection housing 3 in a flat manner without flanges. To reinforce the control plate, a bent-over edge 50 is provided which lies outside these housing parts. Likewise, the need for a bent-over edge when connecting the control plate to the housing hub 10 was unnecessary. The embodiment in accordance with FIG. 10 results in some cases in a more simple seal relative to the housing parts 3, 5 and 10.

We claim:

1. Liquid-ring gas pump with a working chamber in which an impeller (6) rotates about an axis and is bounded at one axial end by a control plate (7) past which the impeller (6) moves with a small clearance, said control plate having at least one intake and discharge opening (21, 22, 23) and being composed of a rolled sheet material, characterized in that the control plate has a generally planar body with intake and discharge openings having peripheral edges at least in part bent out of the plane of said body to provide raised portions extending away from the impeller (6) and rounded portions confronting the working chamber.

2. Liquid-ring gas pump according to claim 1, characterized in that the peripheral area of the control plate (7) is provided with a groove (35) for the reception of an O ring (36).

3. Liquid-ring gas pump according to claim 1, characterized in that the periphery of the control plate (7) is flanged.

4. Liquid-ring gas pump according to claim 1, characterized in that the control plate (7) has a hole (46) for the passage of a shaft, the edge (47) of which is bent over and raised on one side.

5. Liquid-ring gas pump according to claim 1, characterized in that the impeller includes a hub (16), the control plate (7) has a circular recessed bead (44) and a bearing ring (45) is seated against said recessed bead for interaction with said hub.

6. Liquid-ring gas pump according to claim 1, characterized in that the rolled sheet forming the control plate is no more than 4 mm thick.

7. Liquid-ring gas pump according to claim 2, characterized in that the rolled sheet forming the control plate has a thickness in the range of about 2.5 to 3.5 mm.

8. Liquid-ring gas pump according to claim 1, characterized in that one of the discharge openings is a continuously open discharge opening and, on the side of the control plate confronting the impeller (6), the continuously open discharge opening (22) is provided with a bent-out part (32) which partially covers the opening.

9. Liquid-ring gas pump according to claim 4, characterized in that the bent-out part (32) forms a trough in relation to the working chamber.

10. Liquid-ring gas pump according to claim 1, characterized in that the impeller includes a hub (16) and the control plate (7) has a reinforcing bead adjacent to the impeller hub (16).

11. Liquid-ring gas pump according to claim 10, characterized in that the bead (39) extends radially of the impeller axis.

12. Liquid-ring gas pump according to claim 1, characterized in that it includes valve elements (27), one or more discharge openings (23) interacting with the valve elements (27) whereby the bent-over peripheral edge of the discharge openings (23) form a valve seat for the valve elements (27).

13. Liquid-ring gas pump according to claim 12, characterized in that the valve elements (27) include a valve housing component (28) mounted in the region of the control plate's discharge openings (23), said valve housing component providing reinforcement for the control plate.

14. Liquid-ring gas pump according to claim 13, characterized in that the valve housing component (28) has a projection (24) which extends at a distance from the impeller (6).

* * * * *